US006854402B2

(12) United States Patent
DuBarry et al.

(10) Patent No.: US 6,854,402 B2
(45) Date of Patent: Feb. 15, 2005

(54) ADJUSTABLE SHELF

(76) Inventors: Suzanne DuBarry, 4691 White Oak Pl., Encino, CA (US) 91316; Kevin G. Abelbeck, 4691 White Oak Pl., Encino, CA (US) 91316

( * ) Notice: Subject to any disclaimer, the term of this patent is extended or adjusted under 35 U.S.C. 154(b) by 99 days.

(21) Appl. No.: 10/232,982

(22) Filed: Aug. 30, 2002

(65) Prior Publication Data

US 2003/0198230 A1 Oct. 23, 2003

Related U.S. Application Data

(60) Provisional application No. 60/374,240, filed on Apr. 19, 2002.

(51) Int. Cl.[7] ..... A47B 9/00

(52) U.S. Cl. ..... 108/146; 108/147.21; 108/137

(58) Field of Search ..... 108/146, 147.21, 108/147.19, 137, 143, 50.01, 50.02, 88, 89, 49

(56) References Cited

U.S. PATENT DOCUMENTS

| | | | | |
|---|---|---|---|---|
| 1,048,143 A | | 12/1912 | Franke | |
| 2,937,765 A | * | 5/1960 | Shank | 108/143 |
| 3,701,506 A | * | 10/1972 | Favreau | 108/147.21 |
| 3,737,136 A | | 6/1973 | Snurr | |
| 4,239,169 A | | 12/1980 | DeSantis | |
| 4,286,525 A | * | 9/1981 | Willmore | 108/93 |
| 4,492,170 A | * | 1/1985 | Solomon | 108/148 |
| 4,735,471 A | | 4/1988 | Riggsby | |
| 5,127,342 A | | 7/1992 | Taylor | |
| 5,199,778 A | | 4/1993 | Aoki et al. | |
| 5,285,733 A | * | 2/1994 | Waibel | 108/147.19 |
| 5,799,588 A | | 9/1998 | Engel | |
| 5,802,988 A | | 9/1998 | Shields | |
| 6,029,587 A | * | 2/2000 | Rozier et al. | 108/147.21 |
| 6,092,708 A | * | 7/2000 | Rand | 108/44 |
| 6,213,434 B1 | | 4/2001 | Reichanadter, Jr. | |
| 6,240,856 B1 | * | 6/2001 | Paskey et al. | 108/146 |
| 6,241,106 B1 | | 6/2001 | Fujita et al. | |

FOREIGN PATENT DOCUMENTS

| | | | |
|---|---|---|---|
| DE | 3510338 | * | 4/1986 |
| EP | 046140 | * | 2/1982 |
| GB | 2262029 | * | 6/1993 |

* cited by examiner

*Primary Examiner*—Jose V. Chen

(57) ABSTRACT

A shelf stores items and provides for organized and attractive display with ease of item access. Conforming to a defined physical environment or variable storage space optimally requires the shelf to provide for both vertical and horizontal adjustment. Here this is accomplished by a pair of legs that are telescopic (to reduce size) and can be locked at a height (vertical adjustment) by use of a pawl, pin, screw or other fastener known in the art. The shelf includes a planar surface that is comprised of a shelf portion, which is supported on each distal end by a leg extension. The leg extensions are mounted to the upper area of the legs. The leg extensions are received by the shelf portion, being movably mounted thereto. This allows for horizontal (width) adjustment. An end cover can be used to provide a flat surface that is consistent with the upper surface of the shelf portion. Feet are added to provide a more solid footing, the feet being removable and providing a mounting tab at the end of the legs and a mounting tab receiver at the opposite end of the legs. This allows for multiple shelves to be securely mounted one on the other.

33 Claims, 10 Drawing Sheets

ADJUSTABLE SHELF

This application claims the benefit of Provisional Application No. 60/374,240, filed Apr. 19, 2002.

FIELD OF THE INVENTION

The present invention generally relates to storage and display items. More specifically, the present invention relates to shelving and even more specifically to adjustable shelving adapted to conform to a desired dimension.

BACKGROUND OF THE INVENTION

As our lifestyles become more and more complex, we desire devices that enable organization. This helps to bring our lives some sort of normality. Shelving products have evolved since the days of the uncovered "cup boards" in the late $18^{th}$ century to the modern cabinets with decorator doors and movable shelving as seen today. Though the shelving is typically "movable" it is not easy to move. The shelves must be unloaded, some sort of stop or mounting on two or more corners must be removed, and repositioned, the shelf reinstalled and then the shelf can again be loaded. This is a time consuming and labor-intensive project. As such, it is usually only done when the shelving is installed and never moved again. Many people are unaware that their shelving is movable.

As far a width adjustment, there are very few choices. For the most part this is restricted to buying or building the shelf or bookcase at the desired width. That will never be changed.

There are some "cup rack" type supports that offer a width adjustment. These usually include a base with an extension on one side. One of the problems is since there is an extension on a side the upper surface now has two levels, one for the base and one for the extension. This uneven surface is not only unattractive, but does not lend itself well to stacking items. Also, these devices do not provide for vertical or height adjustment.

SUMMARY OF THE INVENTION

In one aspect, the invention features a shelf with an adjustable height first leg and an adjustable height second leg positioned adjacent to the first leg. A leg extension is mounted to the first leg and the second leg, and positioned substantially orthogonal thereto. Also, a shelf portion is used that is capable of being received by the leg extensions, the shelf portion being movably mounted thereon, whereby width adjustment is enabled by varying placement of the shelf relative to the leg extensions. The shelf portion and the leg extensions may be movably mounted one to the other by a tongue in groove. In the preferred embodiment the leg extension includes the groove and the shelf portion includes the tongue.

The system may also include the adjustable height first leg and adjustable height second leg as each being comprised of a first portion and a second portion, which are movably mounted one to the other. The two-part construction of the legs may also include a lock releasably securing the first portion to the second portion. The lock may be a device such as a pawl, a screw or a pin. The pawl can be pivotally mounted to the first portion, and may include a bias, such as a spring or more specifically a spring coil. The second portion would include a rack and the bias applies a force to enable engagement of the pawl and the rack.

The device may also include a comprising an end cover, which is capable of receiving the leg extension and end cover may be modifiable in length. This can be accomplished by providing a plurality of undercuts on the end cover.

The first leg and the second leg may include a foot positioned on a distal end thereof and opposite to the shelf portion, as a support on which the shelf may stand. The feet can be mounted to the legs by providing the first leg and the second leg each with a mounting tab positioned on a distal end thereof and opposite to the shelf portion. A mounting tab receiver is then positioned adjacent to the shelf portion on the leg opposite to the mounting tab. This also enables stacking of one shelf on the other by removing the feet and inserting the mounting tabs of one shelf in the mounting tab receivers of another shelf, thus releasably securing one to the other.

In another aspect, the invention includes a method of providing an adjustable shelf as described, placing the device in said specific area and adjusting the height of the first leg and the second leg to provide a preferred vertical position of the shelf portion. The horizontal adjustment is then provided by adjusting the placement of the first leg and the second leg, thereby allowing the shelf portion to move relative to, and yet be supported by, the leg extensions.

BRIEF DESCRIPTION OF THE DRAWINGS

The foregoing and other objects of this invention, the various features thereof, as well as the invention itself, may be more fully understood from the following description, when read together with the accompanying drawings, described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
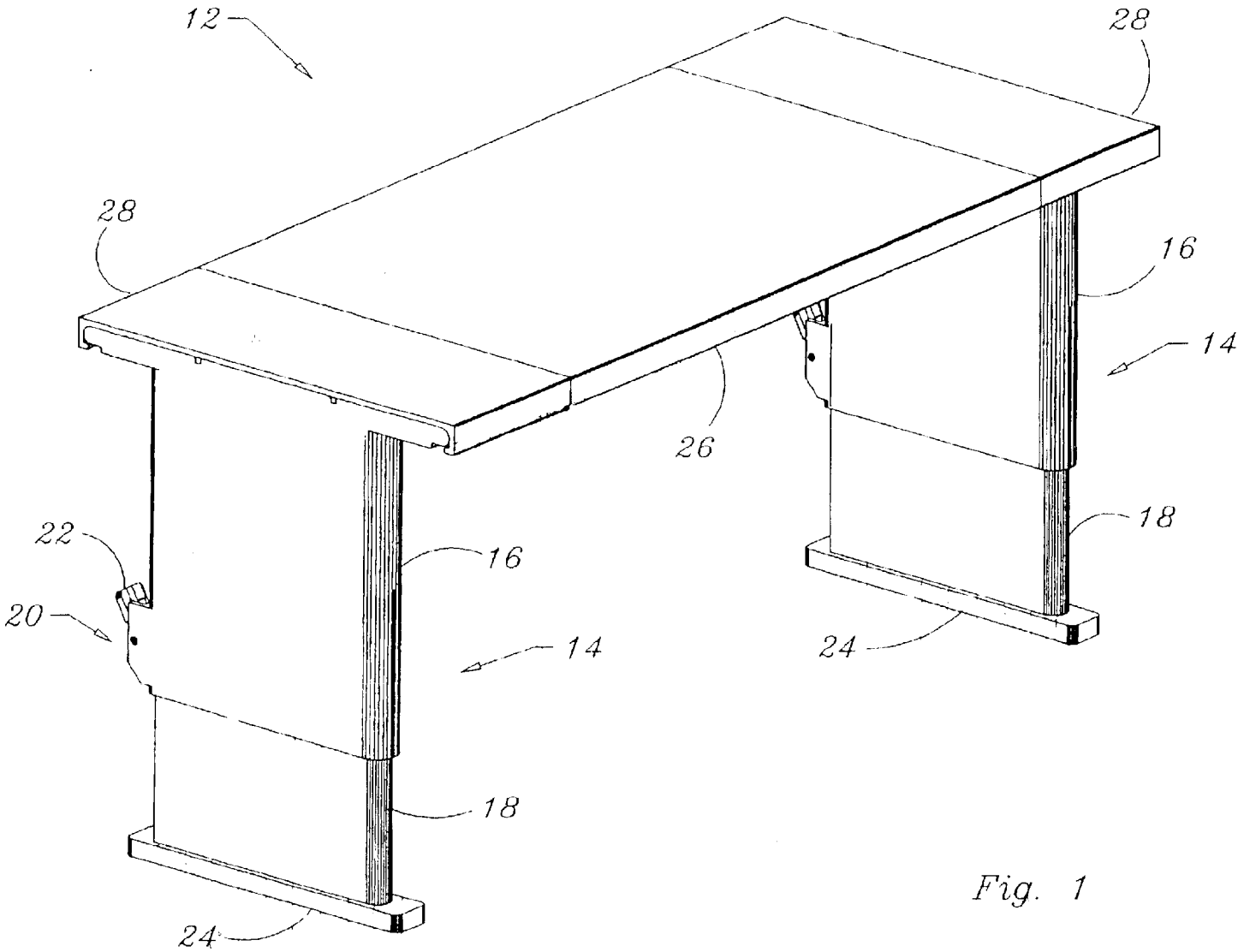
FIG. 1 is an isometric front, upper view of an adjustable shelf produced in accordance with the present invention.

The present invention is an adjustable shelf that enables both vertical and horizontal adjustment. The fully assembled shelf 12 is shown in FIG. 1. This is a front, side, upper view that shows the preferred legs 14 which are comprised of a first portion 16 and a second portion 18. This two-part telescoping leg assembly allows for compact storage and an elegant appearance. A lock 20, shown here as a pawl 22, provides a set leg length that can be determined by the user. On the bottom of the second portion 18 of the leg 14, is positioned a foot 24. The foot 24 is optimally releasably mounted to the end of the second portion 18, but can be permanently fixed thereto. The advantage of the releasable mounting will be discussed later.

The upper end of the first portion 16 supports a planar surface including a shelf portion 26 and may include one or more end covers 28. The end covers 28 and the shelf portion 26 comprise the supportive surface on which items can be stored.

Figure 2:
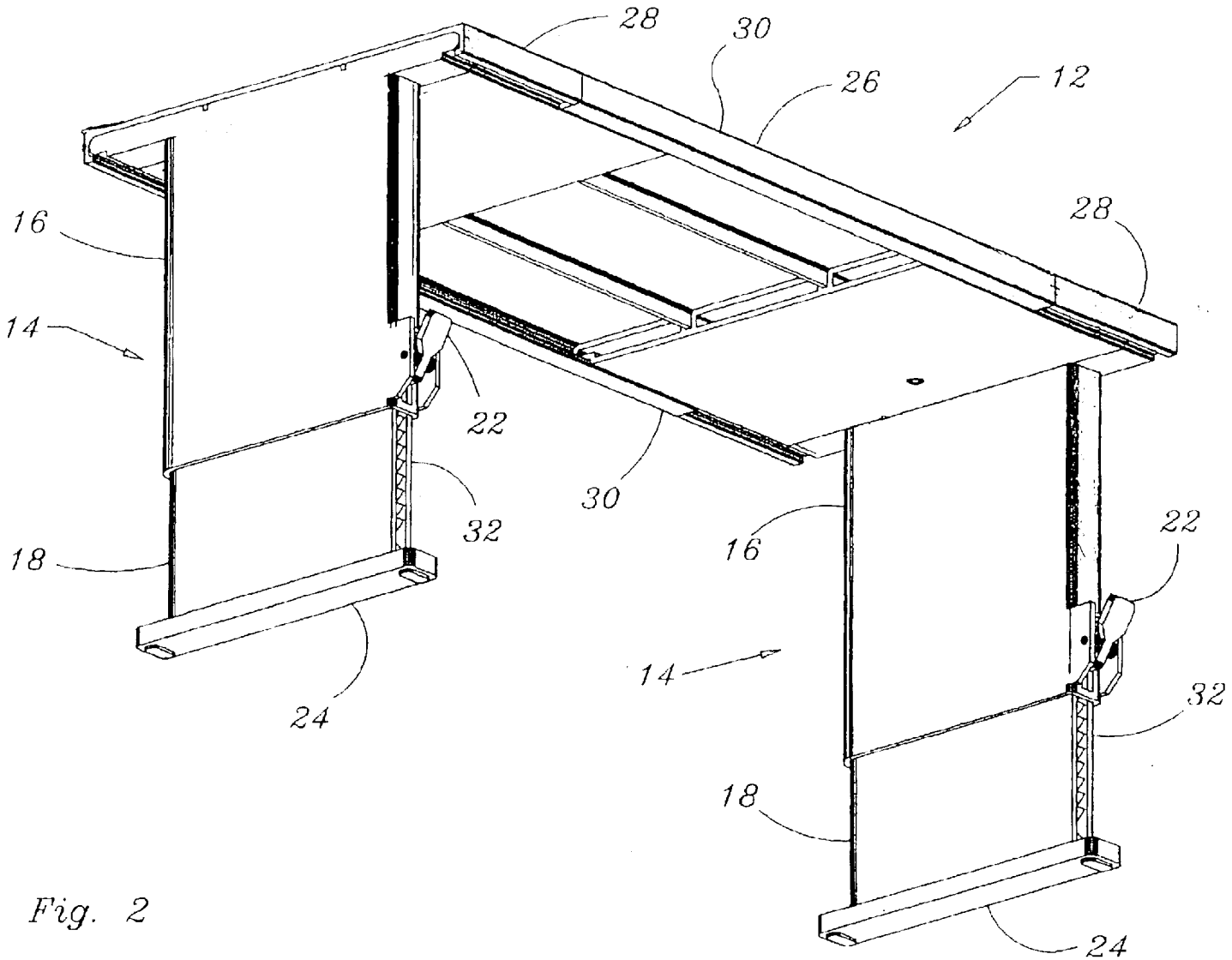
FIG. 2 is an isometric rear, lower view of an adjustable shelf produced in accordance with the present invention.

In FIG. 2 the "under side" of the shelf 12 is shown from the back. Here in the preferred embodiment the shelf portion 26 is shown to be open from the bottom. Leg extensions 30 are supported to the upper portions of the legs 14 and extend toward the other leg. This provides a "track" that enables the shelf portion 26 to move with respect to, while being supported thereon. The inside edges of the leg extensions 30 can be moved closer to or further apart from each other thus enabling a variation in shelf width.

The height adjustment of the legs 14 is more clearly seen in this figure. In this, the preferred embodiment, the second portion 18 of the leg 14 includes a rack 32. This rack 32 can be molded into the second portion 18, as shown here or it can be a separate part that is mounted thereto. In either case, the rack includes teeth that provide a graduated vertical set of "steps" for attachment of the pawl to conditionally secure the first and second portions of the legs. This provides an easy and efficient method of adjustment of the vertical aspect of the shelf.

Figure 3:
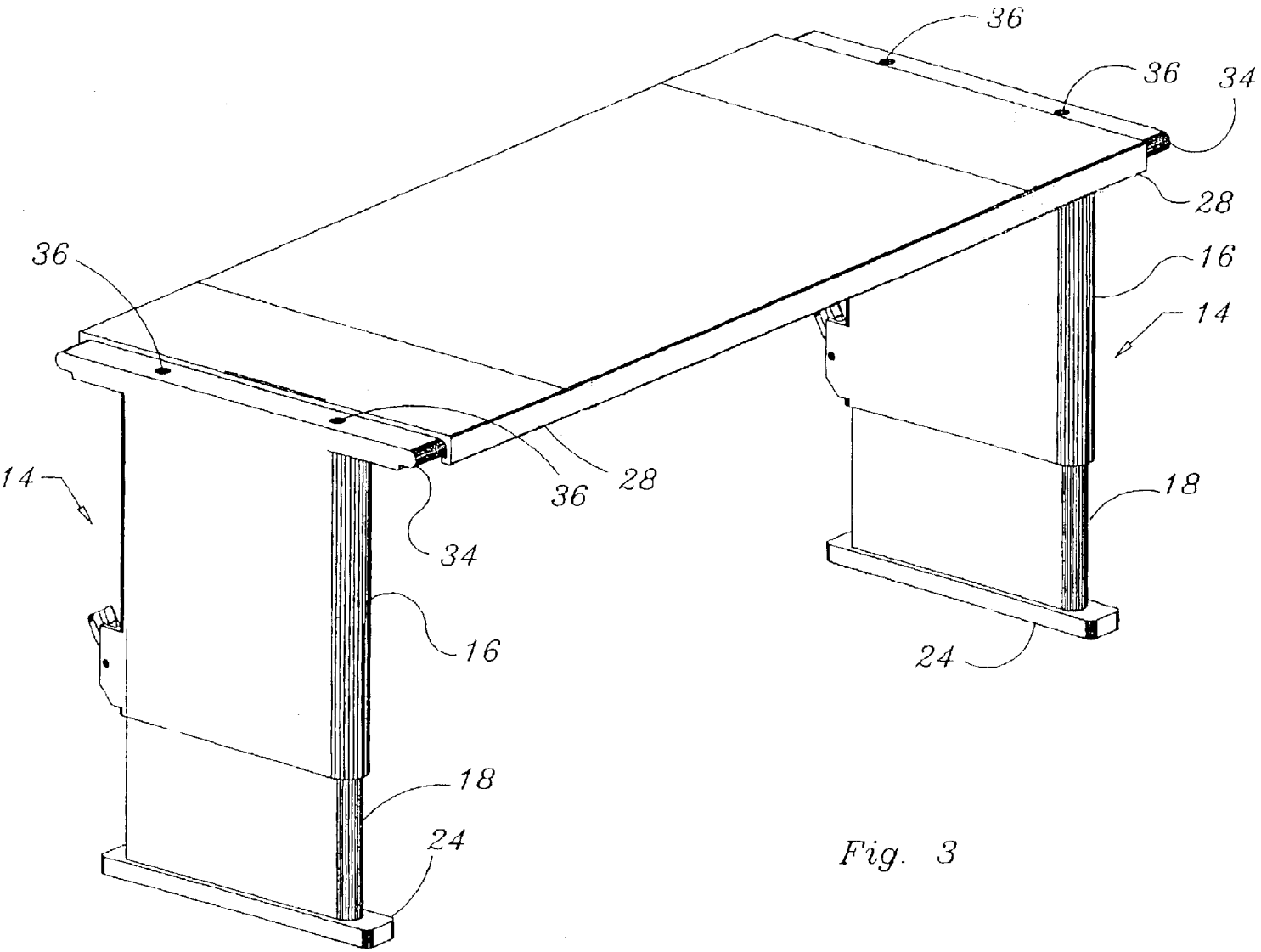
FIG. 3 is an isometric front, upper view of an adjustable shelf with the end covers shortened to allow access to the tab receivers thus enabling stacking of multiple shelves, the shelves made in accordance with the present invention.

In FIG. 3, at the top end of the first portion 16 of the leg 14 is a leg base 34. The leg base 34 has a primary function of providing a cap for the upper edge of the first portion 16 of the leg 14 as well as providing an attachment for the leg extension (item 30 shown in FIG. 2). The leg base 34 can be exposed by either shortening the end covers 28, or by extending the legs 14 further away from one another.

The leg base 34 may include one or more mounting tab receivers 36. These receivers 36 can take a variety of shapes and configurations, but are intended to mate with mounting tabs (not shown here) on the bottom end of the second portion 18 of the leg 14. The foot 24 is releasably fastened to the second portion 18 by the foot also including tab receivers, similar to those in the leg base 34. This combination allows the user to stack a second shelf on a first shelf by remove the foot 24 from the second shelf and placing the mounting tabs exposed by removing the foot 24, and placing the tabs into the receivers 36 on the leg base 34 of the first shelf. This allows secure stacking of one shelf on the other.

Figure 4:
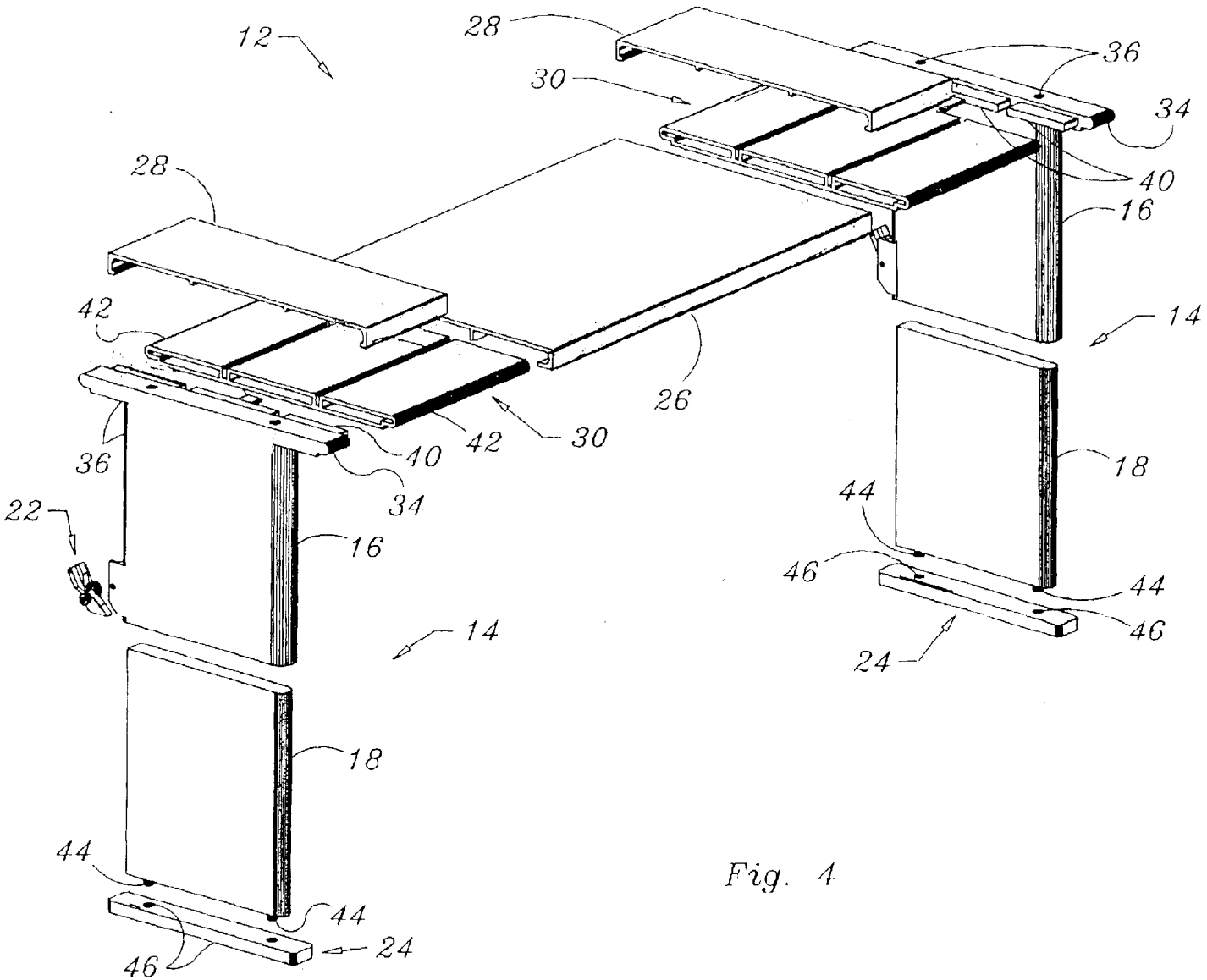
FIG. 4 is an exploded isometric front, upper view of an adjustable shelf produced in accordance with the present invention.

An exploded view of the invention 12 is shown in FIG. 4 to better shown the relationship between the parts. The leg extension 30 is shown here to be releasably secured to the leg base 34. This is done to provide for a more efficient "knock down" of the product to reduce shipping costs. A locking tab 38 is used to articulate with a hole in the bottom of the leg extension 30 and they are supported together by the leg protrusions 40 that mate with the protrusion cavities 42 on the leg extension 30. This is only one method of assembly of these parts and is not intended to limit the scope of the invention. The invention can also be manufactured such that the leg extensions and the leg base 34 are one part.

The shape of the leg extension 30 is shown here to mate with and allow movement of the shelf portion 26 relative thereto. The ability of the shelf portion 26 to slide against the leg extension 30 and yet be supported by the leg extensions 30, allows for horizontal adjustment of the leg positions.

The vertical adjustment is provided by the second portion 18, which is received by the first portion 16 of the leg 14. The lock in the form of a pawl 22 is shown to also be exploded from the first portion 16. The details of this and other locks will be discussed later.

At the lower distal end of the second portion 18 are more clearly shown the mounting tabs 44. These tabs 44 are shown here to be substantially in the shape of a cylindrical pin, but this general shape and specific details are not critical to the novelty of the invention. The tab receivers 46 in the feet 24 are made to fit the tabs 44, thereby releasably locking them together. In a similar manner each leg base 34 also includes a receiver 36 to allow for stacking of the shelves 12, as previously noted.

Figure 5:
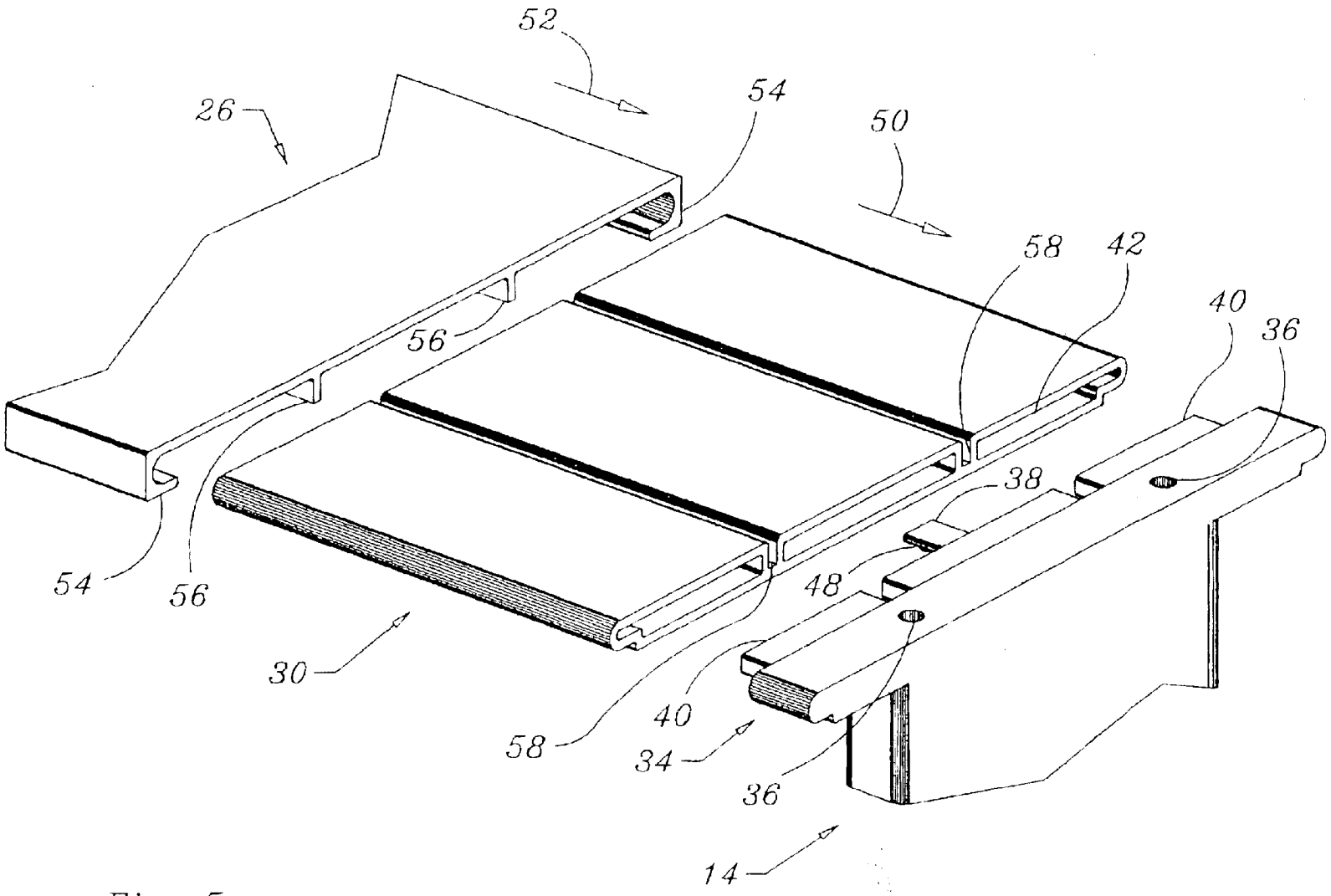
FIG. 5 is an exploded isometric upper view of the upper portion of a leg, a leg extension and a section of a shelf portion, showing the assembly, the shelf produced in accordance with the present invention.

Further detail of the function and assembly of the leg 14 via the leg base 34 to the leg extension 30 is shown in FIG. 5. The leg protrusions 40 are received by the protrusion cavities 42 of the leg extension 30. The locking tab 38 includes a pin 48 which extends downward from the underneath side of the tab 38. This pin 48 also extends through a cavity 42 to be received by a hole in the bottom of the extension 30. With the protrusions 40 positioned within the cavities 42 (as shown by the arrow 50) and the pin 48 securing them in place, the structure of the leg 14 with the leg extension 30 via the leg base 34 is functionally one rigid unit.

The shelf portion 26 is received by the leg extension 30 as shown by the second arrow 52. Though the shelf portion 26 can take a variety of forms, what is shown is considered by the applicants to be the preferred embodiment. The bottom side of the shelf portion 26 is open except for the "C" shaped edges 54. These "rails" run the length of the shelf portion 26 to provide for structural rigidity of the shelf portion 26 without excess material to cause potential part interference, added weight or cost. The shelf portion also includes a pair of tongues 56. The tongue 56 has a multi-fold purpose. First the material placement adds to the section modulus of the shelf portion about the axis that would see flexion when the shelf is loaded. This adds to the strength of the shelf portion especially when the shelf is at an extended position where a minimal amount of contact is made between the shelf portion 26 and the leg extensions 30.

The second purpose to the tongue 56 is as a tracking guide along the grooves 58 located within the leg extensions 30. This tracking assistance reduces the likelihood for the shelf portion 26 to bind when moving along the leg extension 30 when the shelf width is being changed.

The third advantage to the tongue 56 and groove 58 combination is during the loading of the shelf. When items are placed on the shelf portion 26, during its intended purpose of item storage, the weight of these items will cause the leg extensions 30 to flex slightly along an axis parallel to the long axis of the grooves 58. This is due to the reduced section at the grooves due to the presence of the grooves 58. The upper portion is open. When this happens the outside upper edges of the groove 58 will pinch together slightly, grabbing the tongue positioned there between. The friction due to the contact of the tongue and grooves acts as a "lock" to further stabilize the shelf and prevent it from moving from side to side when it is loaded. This eliminates the need for further locking of the shelf portion 26 to the leg extensions 30 when the shelf is in place. Under more extreme conditions, an additional lock mechanism may be used.

As such, it is understood that any form of locking mechanism known in the art can be added between the shelf portion 26 and the leg extensions 30.

Figure 6:
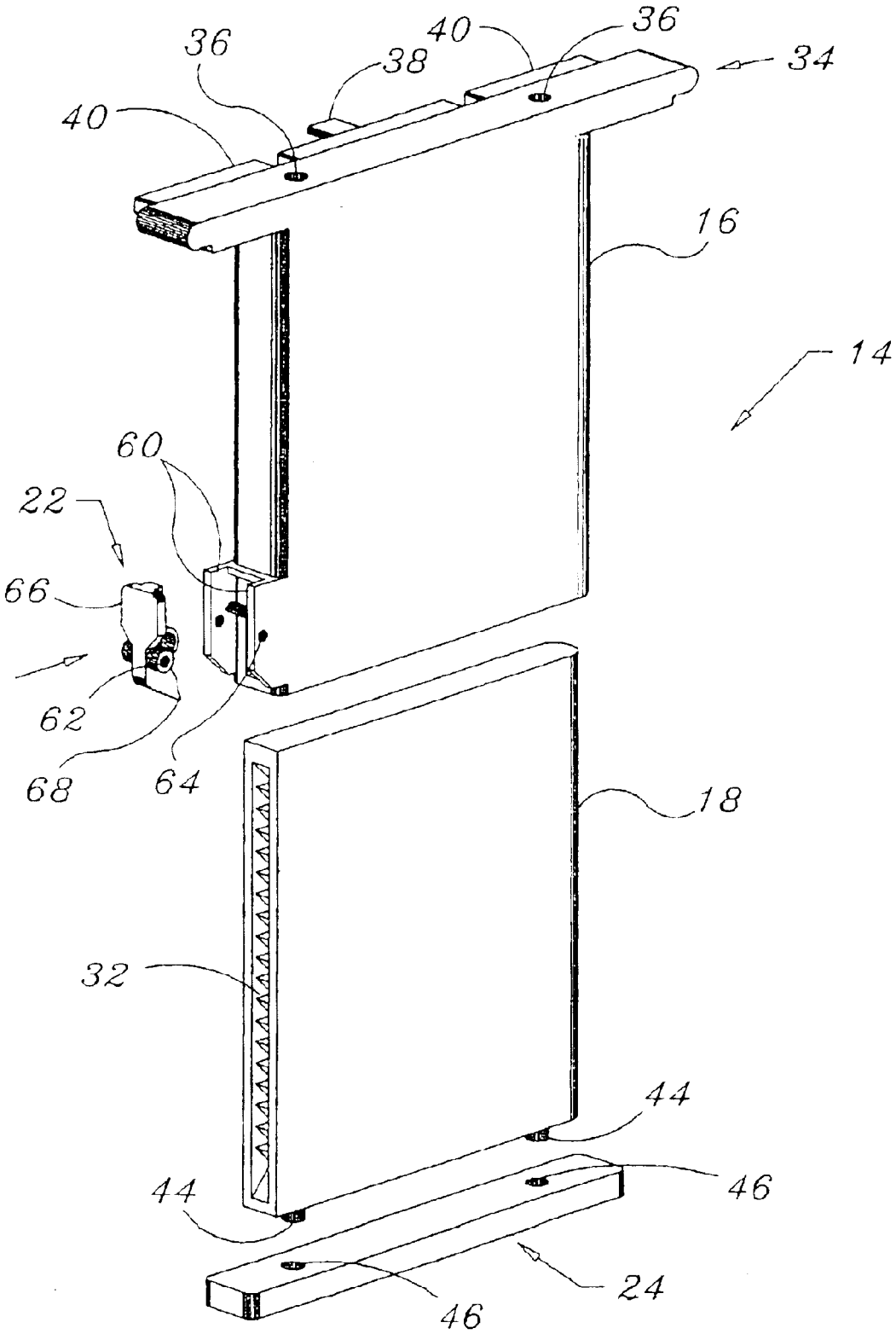
FIG. 6 is an exploded rear isometric view of a leg and foot assembly produced in accordance with the present invention.

A single leg 14 is shown in FIG. 6. Here the first portion 16 is shown with a pair of ears 60, which hold the pawl 22 as it is pinned through the pawl hole 62 and the ear holes 64. The pawl includes a pawl handle 66 and a pawl tip 68. The handle acts to enable the user to manipulate the pawl tip 68 to disengage it from the rack teeth 32 in the second portion 18 of the leg. The mounting tabs 44 are received by the tab receivers 46 in the foot 24. Also as previously noted, the mounting tabs 44 of another leg can be received by the receivers 36 in the leg base 34.

Figure 7:
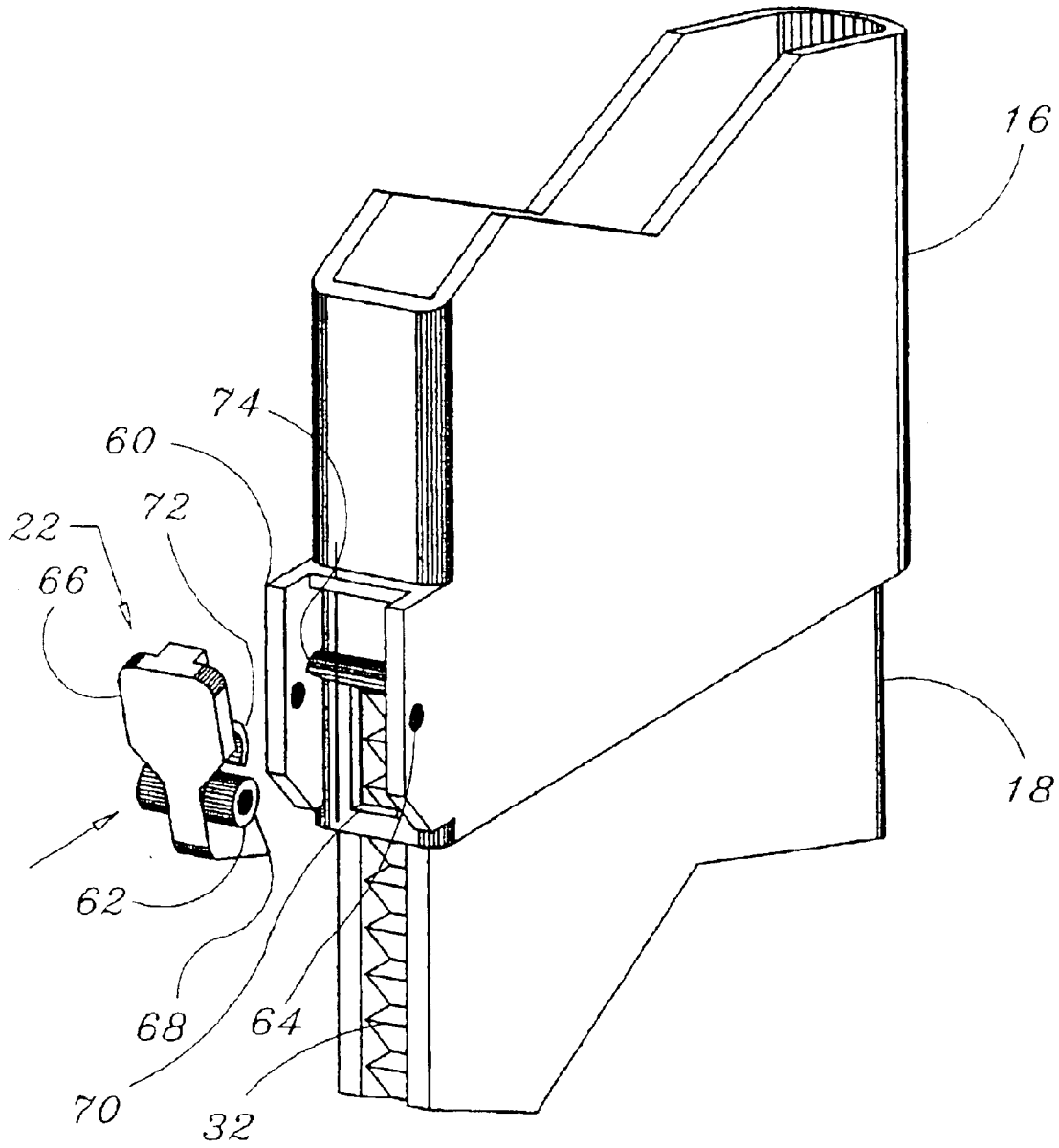
FIG. 7 is an exploded isometric view of a pawl and rack height adjustment lock produced in accordance with the present invention.

A more detailed view of the locking mechanism is shown in FIG. 7. The pawl 22 is shown as removed from the first portion 16 showing the rack window 70. This window 70 allows access of the pawl tip 68 to the rack teeth 32. The pawl 22 can be manufactured from an number of materials but is preferably made from a plastic. This is inexpensive and allows for good elastic properties. The elastic properties are relevant in that in the preferred embodiment the pawl also includes a spring coil 72. This spring can be a separate item that is attached to the pawl 22 or as in this case a molded portion of the pawl 22. The free end of the spring coil 72 is positioned on the ridge 74 located above the window 70 and on the first portion 16. The spring then pushes the handle 66 of the pawl 22 out away from the rack 32, about the pivot of the pawl hole 62 and the ear holes 64, thus engaging the pawl tip 68 into the rack teeth 32. To disengage the pawl tip 68 from the rack 32, the handle 66 is pressed in toward the first portion 16, pulling the tip away form the rack teeth 32. This flexes the spring 72 so when the handle 66 is released by the user, the bias from the spring 72 reengages the tip 68 and the rack 32, locking one to the other.

Figure 8:
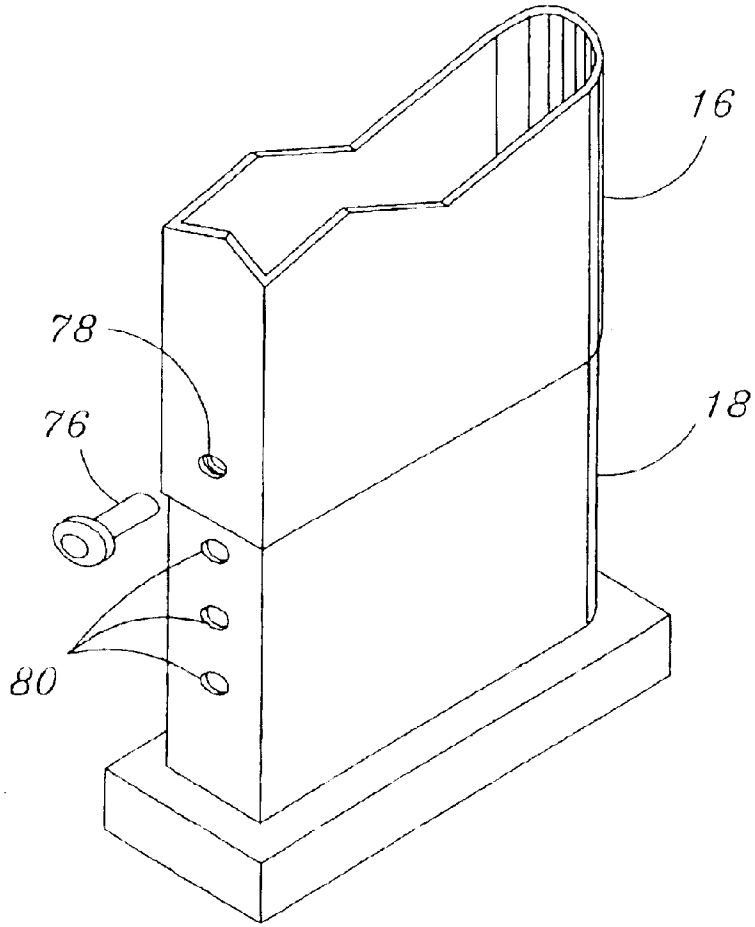
FIG. 8 is an isometric view of a leg and foot assembly with a pin lock, the device produced in accordance with the present invention.

Another form of locking of the first portion 16 and the second portion 18 is accomplished by a pin 76 as shown in FIG. 8. Here the pin 76 is shown as it would be assembled into a first hole 78 located in the first portion 16 and also one of a plurality of second holes 80 located in the second portion 18. The first portion 16 is still able to move along the long axis of the second portion 18, as previously noted, only the locking mechanism is comprised of the pin 76 positioned through a pair of properly aligned holes (78 and 80).

Figure 9:
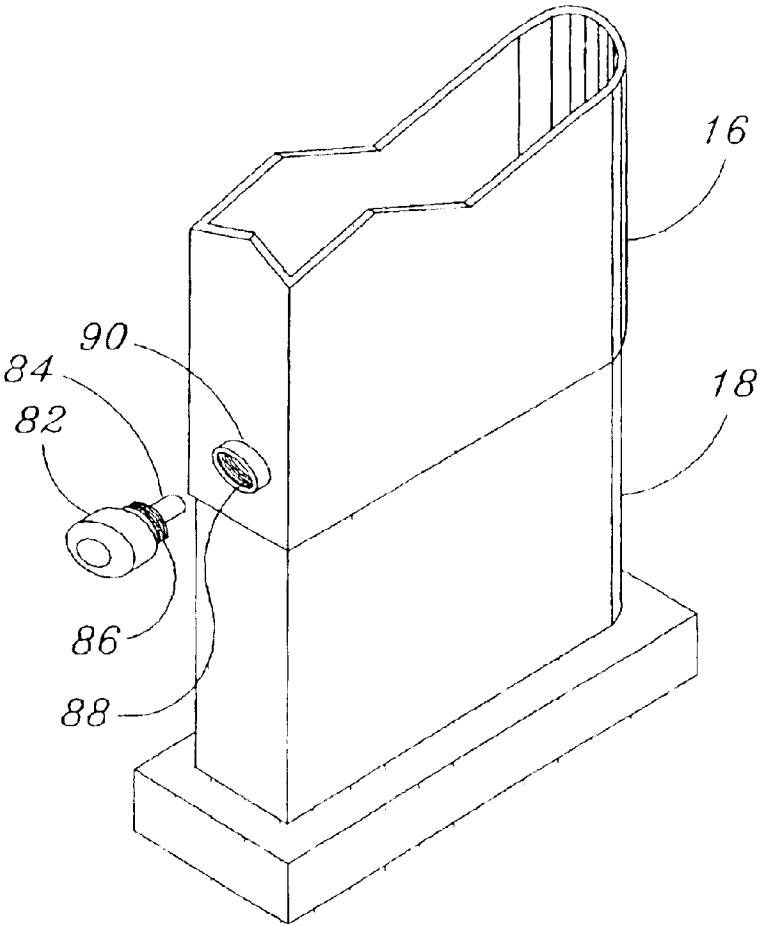
FIG. 9 is an isometric view of a leg and foot assembly with a screw knob lock, the device produced in accordance with the present invention.

To achieve an infinite variety of height adjustments, a screw knob can be used for height adjustment. This is illustrated in FIG. 9. Here a knob 82 with a pressure pin 84 mounted to the end also includes a threaded portion 86. The threaded portion 86 is received by the mating threads 88 on a receiver 90, which is mounted to the first portion 16. A hole (not shown) is located within the receiver 90 to allow the pressure pin 84 access through the first portion 16 to contact the second portion 18. The friction between the pin 84 and the second portion 18 is provided and varied by the amount of tightening of the knob 82, thus pushing the pin 84 more firmly against the second portion 18.

Figure 10B:
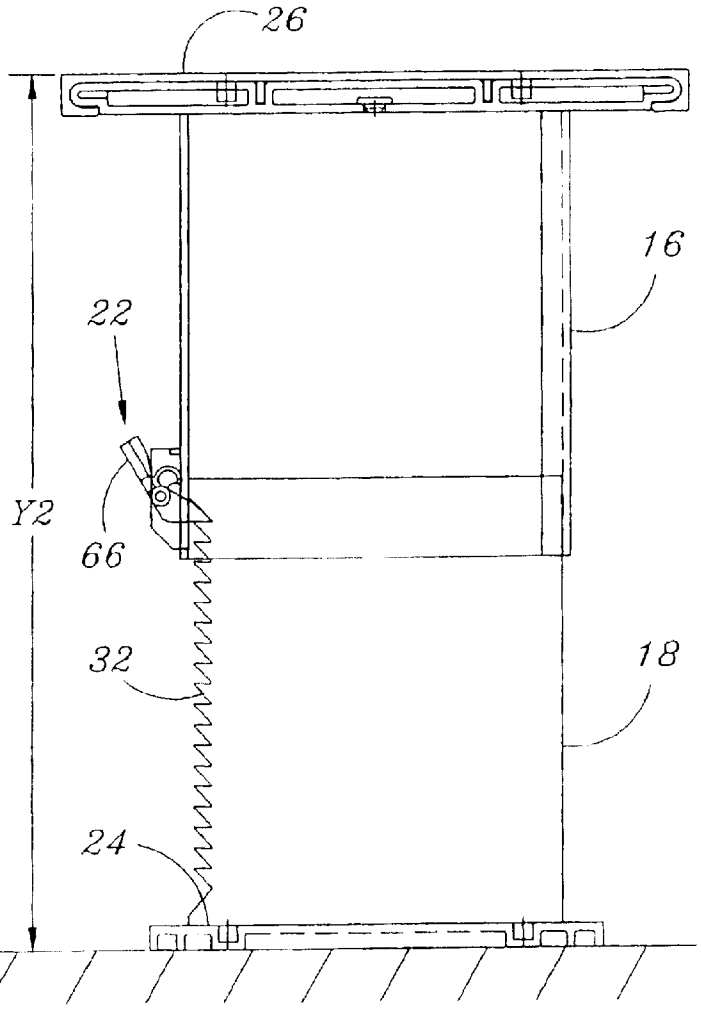
FIGS. 10*a* and 10*b* are side views of an adjustable shelf in retracted and vertically extended positions respectively, the device produced in accordance with the present invention.
Figure 10A:
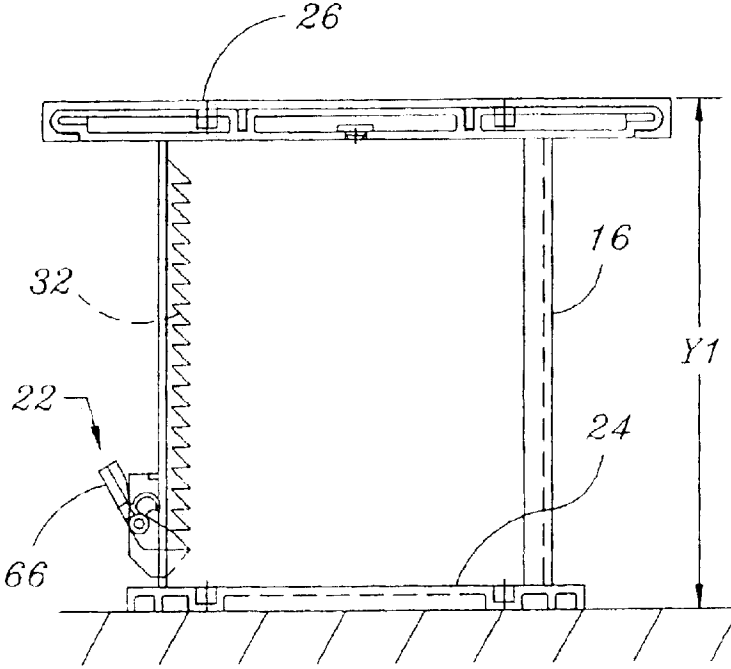

The height adjustment of the device is shown in a side view in FIGS. 10*a* and 10*b*. The minimum height of "Y1" is shown in FIG. 10*a* where the pawl 22 is at the bottom of the rack 32. The highest position "Y2" is shown in FIG. 10*b*. The difference being the relative positioning of the first portion 16 to the second portion 18 and as held in place by the pawl 22 and rack 32. The rack 32 design is also shown here to be of a saw-tooth design. This provides a vertical slant upward followed by a substantially horizontal "ledge". The pawl tip 68 includes a shape that nearly matches this "V", thus providing a locking of the pawl 22 to prevent downward movement of the first portion 16. In this application, this design is beneficial in that little resistance is offered to restrict vertical movement of the first portion relative 16 to the second portion 18. This allows the user to lift the shelf portion 26, and the weight of the second portion 18 and the feet 24 will allow the second portion to "fall" away from the first portion 16, thus "ratcheting" out to fit the height needs of the user. When the user desires a lower height, the user needs only to press the handle 66 of the pawl 22 in, releasing the pawl tip and allowing the first portion 16 to freely move relative to the second portion 18.

Figure 11A:
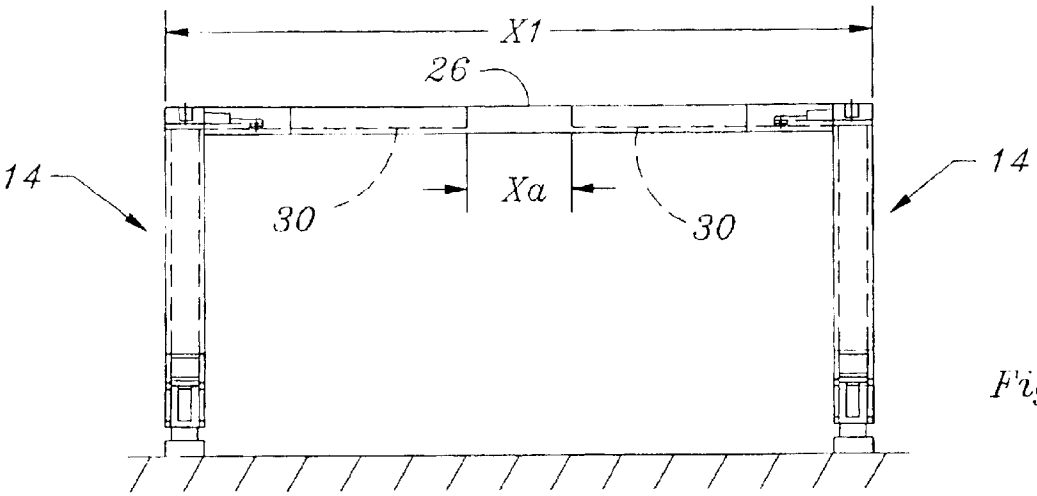
FIGS. 11*a* and 11*b* are rear views of an adjustable shelf in a vertically retracted position showing both compact and extended horizontal positions respectively, the device produced in accordance with the present invention.
Figure 11B:
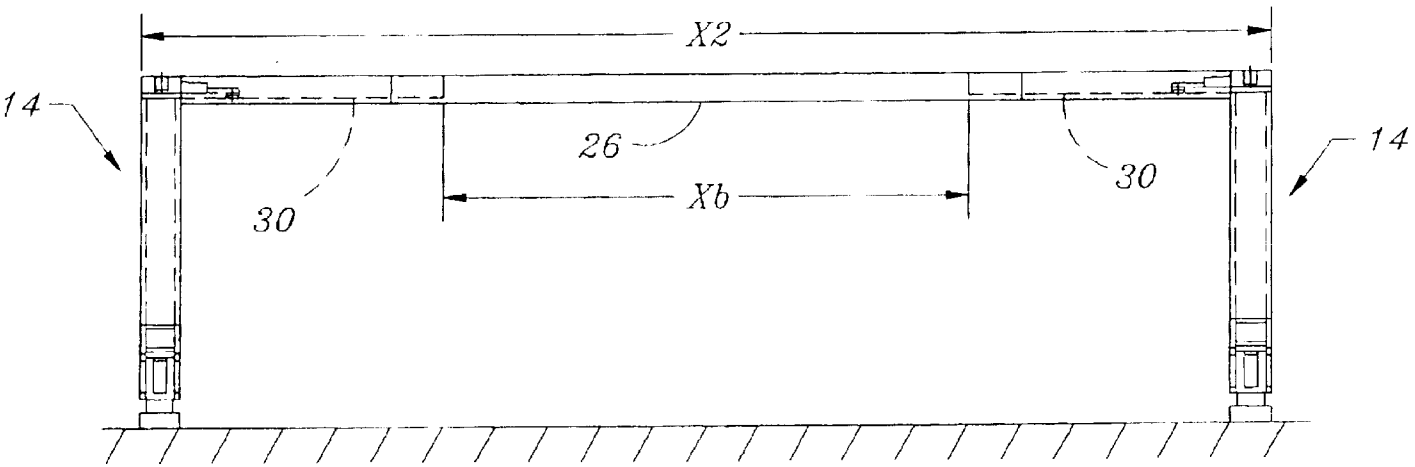

FIGS. 11*a* and 11*b* show the horizontal width adjustment provided by the device. The narrow position is shown by the dimension "X1" in FIG. 11*a* and the widest dimension is depicted by "X2" in FIG. 11*b*. As can be seen here, the shelf portion 26 remains at a constant place in both positions. The relative position of the legs 14 and the gap between the leg extensions 30 increases from "Xa" to "Xb". This provides the increased width. It is understood that both the height adjustment, as shown in FIGS. 10*a* and 10*b*, as well as the width adjustment, as shown here, can both be performed together in any combination allowed by the specific design of the elements of the device. Thereby providing both width and height adjustment in a single shelf to fit any of an infinite number of space requirements.

What is claimed is:

1. A shelf comprising:

an adjustable height first leg and an adjustable height second leg positioned adjacent to the first leg;

a leg extension mounted to said first leg and said second leg, and positioned substantially orthogonal thereto; and a shelf portion capable of being received by said leg extensions, the shelf portion being movably mounted thereon, whereby width adjustment is enabled by varying placement of the shelf relative to said leg extensions.

2. A shelf as in claim 1, wherein said adjustable height first leg and said adjustable height second leg are each comprised of a first portion and a second portion movably mounted one to the other.

3. A shelf as in claim 2, further comprising a lock, releasably securing said first portion to said second portion.

4. A shelf as in claim 3, wherein said lock is a device selected from the group consisting of a pawl, a screw and a pin.

5. A shelf as in claim 4, wherein said pawl is pivotally mounted to said first portion.

6. A shelf as in claim 4, wherein said pawl includes a bias and said second portion includes a rack and said bias applies a force to enable engagement of said pawl and said rack.

7. A shelf as in claim 6, wherein said rack is comprised of a vertical arrangement of a plurality of saw-tooth teeth, each tooth including a flat portion that is substantially horizontal when said second portion is supporting said shelf portion.

8. A shelf as in claim 6, wherein said bias is a spring coil.

9. A shelf as in claim 1, wherein said end cover is modifiable in length.

10. A shelf as in claim 1, wherein said end cover includes a plurality of undercuts.

11. A shelf as in claim 1, wherein said first leg and said second leg include a foot positioned on a distal end thereof and opposite to said shelf portion.

12. A shelf as in claim 1, wherein said first leg and said second leg each include a mounting tab positioned on a distal end thereof and opposite to said shelf portion and a mounting tab receiver positioned adjacent to said shelf portion.

13. A shelf as in claim 12 further comprising a pair of feet that are releasably mounted to said first leg and said second leg by said mounting tab.

14. A shelf as in claim 1, wherein said leg extension and said shelf portion are movably mounted one to the other by a tongue in groove.

15. A shelf as in claim 14, wherein said leg extension includes said groove and said shelf portion includes said tongue.

16. An adjustable support device comprising:

a pair of base legs including a mounting tab on a first end and a mounting tab receiver on a second end, positioned adjacent to one another;

at least two leg extensions, a leg extension mounted to each leg and extending toward the other leg; and a shelf portion adapted to be received by said leg extensions, the shelf portion being movably mounted thereon, whereby width adjustment is enabled by varying placement of the shelf relative to said leg extensions.

17. A support device as in claim 16 wherein said base legs are adjustable in height.

18. A support device as in claim 16 wherein said base legs are comprised of a first portion and a second portion being telescopically received by the first portion.

19. A support device as in claim 18, further comprising a lock, releasably securing said first portion to said second portion.

20. A support device as in claim 19, wherein said lock is a device selected from the group consisting of a pawl, a screw and a pin.

21. A support device as in claim 20, wherein said pawl is pivotally mounted to said first portion.

22. A support device as in claim 20, wherein said pawl includes a bias and said second portion includes a rack and said bias applies a force to enable engagement of said pawl and said rack.

23. A support device as in claim 22, wherein said rack is comprised of a vertical arrangement of a plurality of saw-tooth teeth, each tooth including a flat portion that is substantially horizontal when said second portion is supporting said shelf portion.

24. A support device as in claim 22, wherein said bias is a spring coil.

25. A support device as in claim 16, further comprising an end cover, which is capable of being received by said leg extension.

26. A support device as in claim 25, wherein said end cover is modifiable in length.

27. A support device as in claim 25, wherein said end cover includes a plurality of undercuts.

28. A support device as in claim 16, wherein said first leg and said second leg include a foot positioned on a distal end thereof and opposite to said shelf portion.

29. A support device as in claim 16 further comprising a pair of feet that are releasably mounted to said first leg and said second leg by said mounting tab.

30. A support device as in claim 16, wherein said leg extension and said shelf portion are movably mounted one to the other by a tongue in groove.

31. A support device as in claim 30, wherein said leg extension includes said groove and said shelf portion includes said tongue.

32. A method of positioning a planer surface in a specific area comprising:

providing a device including:

an adjustable height first leg and an adjustable height second leg positioned adjacent to the first leg;

a leg extension mounted to said first leg and said second leg, and positioned substantially orthogonal thereto;

an end cover, adapted to be received by said leg extensions, and a shelf portion capable of being received by said leg extension, the shelf portion being movably mounted thereon, whereby width adjustment is enabled by varying placement of the shelf relative to said leg extensions;

placing said device in said specific area;

adjusting the height of said first leg and said second leg to provide a preferred vertical position of said shelf portion; and adjusting the placement of said first leg and said second leg allowing said shelf portion to move relative to and yet be supported by said leg extensions.

33. The method as described in claim 32, including the steps of:

sizing said end cover to provide a first end cover and a second end cover;

positioning said first end cover between a distal end of said shelf portion and first leg; and positioning said second end cover between a distal end of said shelf portion and said second leg.

* * * * *